US005190389A

United States Patent [19]

Vasas

[11] Patent Number: 5,190,389

[45] Date of Patent: Mar. 2, 1993

[54] WIPER MOUNTING RING

[75] Inventor: Martin M. Vasas, Fairfield, Conn.

[73] Assignee: The Bridgeport Metal Goods Manufacturing Co., Bridgeport, Conn.

[21] Appl. No.: 812,416

[22] Filed: Dec. 23, 1991

[51] Int. Cl.[5] ..... A46B 11/00; A45D 40/00; A45D 40/26

[52] U.S. Cl. ..... 401/122; 401/129

[58] Field of Search ..... 401/122, 129; 132/218

[56] References Cited

U.S. PATENT DOCUMENTS

| | | | |
|---|---|---|---|
| 3,146,806 | 9/1964 | Ginsburg | 401/122 |
| 3,469,928 | 9/1969 | Widegren | 401/122 |
| 3,870,186 | 3/1975 | Reinhard | 401/122 X |
| 4,194,848 | 3/1980 | Kingsford | 401/122 X |
| 4,407,311 | 10/1983 | Gueret | 401/122 |
| 5,052,837 | 10/1991 | Iizuka et al. | 401/122 |

FOREIGN PATENT DOCUMENTS

| | | | |
|---|---|---|---|
| 2097662 | 11/1982 | United Kingdom | 401/122 |

*Primary Examiner*—Steven A. Bratlie
*Attorney, Agent, or Firm*—Parmelee, Bollinger & Bramblett

[57] ABSTRACT

A cosmetics container includes a bottle for holding liquid cosmetics and a cap having extending therefrom a rod and applicator brush for applying the cosmetics. The rod and applicator brush are inserted into the bottle through a resilient wiper comprising a tubular sleeve and an apertured wiper diaphragm. The wiper is mounted in the neck of the bottle by means of a wiper mounting ring, which receives and holds the wiper and snap-fits into the bottle neck. The size of the wiper mounting ring may be varied to fit into various size bottle necks without altering the wiper/applicator/cosmetics combination. The wiper and wiper mounting ring are assembled together prior to insertion into the bottle, so that they can be inspected prior to final assembly.

15 Claims, 1 Drawing Sheet

WIPER MOUNTING RING

BACKGROUND OF THE INVENTION

This invention relates to a wiper mounting ring which mounts a wiper for a cosmetics applicator in the neck of a cosmetics bottle.

Cosmetics, such as mascara, are packaged in a container which includes an applicator. Typically, the applicator is mounted on a rod extending from a cap into a bottle holding the cosmetics. The applicator may be a brush, a foam tip, or a threaded end of the rod. The applicator is stored in the reservoir of cosmetics within the bottle, and the cap is unscrewed and the applicator is pulled out in order to apply the cosmetics.

A wiper is generally provided at the neck of the bottle. The wiper typically includes a diaphragm having an opening therethrough for receiving the applicator and applicator rod. Thus, the rod and applicator are "wiped" of excess cosmetics as the rod and applicator are removed from the bottle.

Wiper designs are very important to the proper operation of an overall cosmetics container and application systems. Many variables are involved, including: the kind of cosmetics, its viscosity, any solid pigmentation, etc.; the type and size of applicator and the diameter of the applicator rod; the size and configuration of the wiper diaphragm, including the size and configuration of the opening, the material and the material's degree of elasticity. A substantial amount of design work and testing is often necessary to get a successful combination of cosmetics, applicator and wiper. Thereafter, the combination must be accurately mass-produced in order to maintain the design parameters and the desired operation.

A particular problem is the desire to use the same cosmetics and applicator in a different size or style of bottle, without losing the benefits of a successful cosmetics/applicator/wiper combination.

SUMMARY OF THE INVENTION

A principal object of the invention herein is to facilitate use of a particular cosmetics/applicator/wiper combination in containers of different size.

An additional object of the invention herein is to adapt the mounting of a wiper of a particular size and configuration to a cosmetics container having a larger neck opening.

Another object of the invention herein is to facilitate mounting of a wiper in a cosmetics container.

A further object of the invention herein is to improve quality control of the mounting of wipers in cosmetics containers.

A wiper mounting ring according to the invention herein is used to mount a wiper in the bottle of a cosmetics container. The bottle has a neck with a threaded exterior and a generally cylindrical interior opening, and a cap includes a rod and applicator which extend centrally through the neck into the bottle when the cap is attached. A wiper is integrally comprised of a sleeve and a resilient, flexible, apertured diaphragm extending across the interior of the sleeve for receiving and wiping the rod and applicator. The outside diameter of the sleeve is less than the inside diameter of the bottle neck. The wiper mounting ring generally comprises a hollow cylindrical wall made of a more rigid material than the wiper. The wiper mounting ring is adapted to mount the wiper sleeve on its inside cylindrical surface, and is further adapted to be mounted and retained in the bottle neck, thereby positioning the wiper in the bottle neck for accommodating the rod and applicator.

According to one feature of the invention, the wiper sleeve includes an upper radially extending lip and the wiper mounting ring includes a notch receiving said lip, for longitudinally positioning the wiper with respect to the wiper mounting ring. According to another aspect of the invention, the wiper includes a plurality of radially extending lugs from its lower surface, which engage with the wiper mounting ring to hold the wiper in its desired position. According to another feature of the invention, the wiper mounting ring includes an inwardly extending radial flange received in a mating groove in the wiper surrounding the wiper diaphragm in order to maximize stability of the wiper diaphragm.

According to other features of the invention herein, the wiper mounting ring is adapted to snap into engagement with the bottle neck, wherein the assembly and inspection of the wiper and wiper mounting ring can be accomplished prior to snapping the wiper mounting ring and wiper into the bottle neck. The wiper mounting ring has a beveled surface facilitating insertion into the bottle neck.

Other objects and features of the invention herein will in part be understood by those skilled in the art and will in part appear in the following description of the preferred embodiment and claims, taken together with the drawings.

DRAWINGS

The same reference numerals refer to the same elements throughout the various Figures.

DESCRIPTION OF PREFERRED EMBODIMENT

Figure 1:
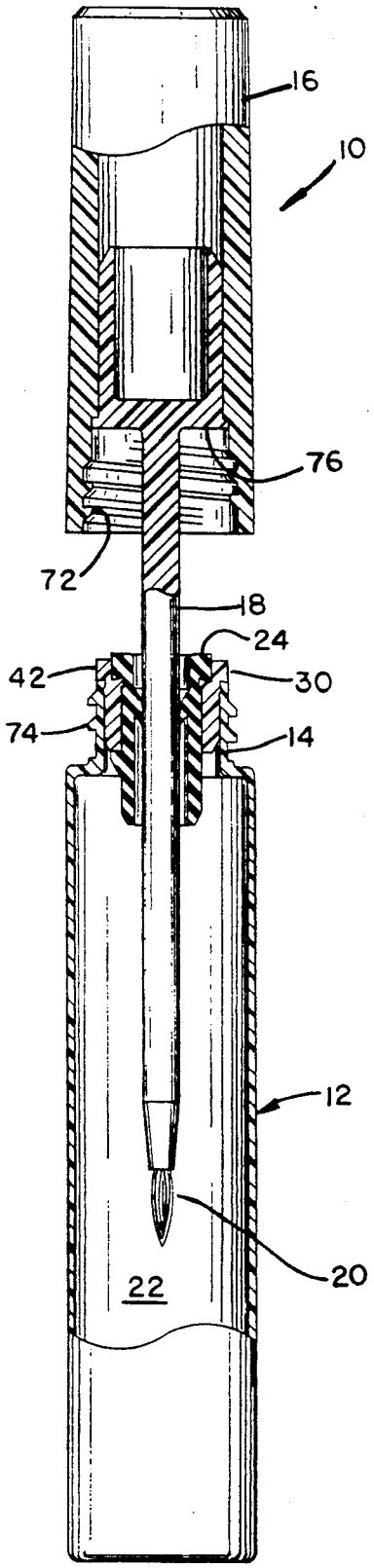
FIG. 1 is a side elevation view, partially cut away and in section, of a cosmetics container incorporating the wiper mounting ring according to the invention herein.

A cosmetics container 10 incorporating a wiper mounting ring according to the invention herein is illustrated in FIG. 1. The cosmetics container 10 generally comprises a bottle 12 having a neck 14 and a cap 16 which screws onto the neck 14. The cosmetics container 10 further includes an applicator rod 18 and an applicator 20 in the form of a brush, which are inserted into the cavity 22 of the bottle through a wiper 24 mounted in the neck of the bottle by a wiper mounting ring 30.

Figure 2:
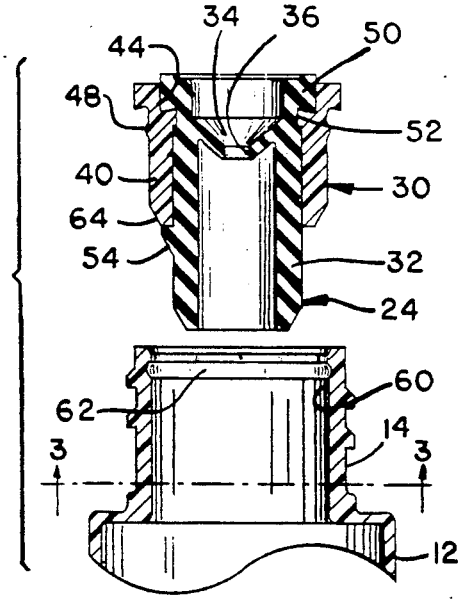
FIG. 2 is an enlarged, exploded sectional view of the neck of the cosmetics container of FIG. 1, including the bottle neck and the assembly of a wiper and wiper mounting ring.
Figure 3:
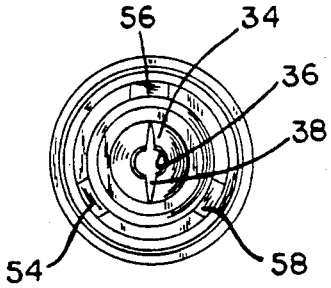
FIG. 3 is a sectional view of the bottle neck, wiper and mounting ring, taken along the lines 3—3 of FIG. 2.
Figure 4:
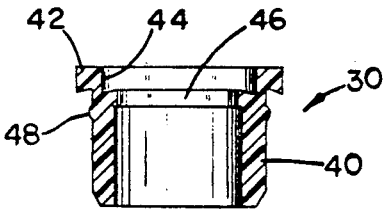
FIG. 4 is an isolated sectional view similar to FIG. 2, of the wiper mounting ring alone.

With reference to FIGS. 2–4, details of the bottle neck, wiper and wiper mounting ring are illustrated. The wiper 24 comprises a cylindrical sleeve 32 and an integral wiper diaphragm 34. In the embodiment shown, the wiper diaphragm is deployed in a depending conical configuration and has a central aperture opening 36. With reference to FIG. 3, the aperture opening is provided in conjunction with a transverse slit 38. The wiper 24 is fabricated of BUNA N elastimer.

It will be appreciated that the wiper 24 is designed and tested to work with particular cosmetics and cosmetics applicators to achieve a desired loading of cosmetics onto the applicator and a desired transfer of the cosmetics from the applicator. Any changes in this combination, such as changing the size of the wiper, can change the wiping action of the diaphragm. Accordingly, once a good combination of cosmetics, applicator and wiper is achieved, it is desirable to avoid any operative changes in that combination.

To that end, the wiper 32 is mounted to the bottle neck 14 by means of the wiper mounting ring 30. The wiper mounting ring 30, shown isolated in FIG. 4, comprises a generally cylindrical sidewall 40. At the upper end of the cylindrical sidewall 40 is a radially projecting rim 42. The wiper mounting ring defines an annular notch 44 on its upper end adjacent to the cylindrical interior of the sidewall. Below the notch 44 is an inwardly projecting annular flange 46. The exterior of the sidewall 40 is provided with an annular raised bead 48.

The wiper 24 also includes a rim 50 at the upper end of sleeve 32, and further defines an annular groove 52 below the rim 50. Thus, the wiper fits into the wiper mounting ring as illustrated in FIGS. 1 and 2, with the rim 50 of the wiper being received in the notch 44 of the wiper mounting ring, and the flange 46 of the wiper mounting ring extending into the groove 52 of the wiper. Additionally, the wiper is provided with three lugs, lug 54 being seen in FIGS. 1 and 2 and lugs 56 and 58 being seen in FIG. 3, which fit over the lower end of the wiper mounting ring sidewall 40. The rim 50 and lugs 54, 56 and 58 hold the wiper longitudinally with respect to the wiper mounting ring, and the flange 46 and groove 52 provide additional longitudinal stability of the flexible wiper in the vicinity of the wiper diaphragm.

The wiper 24 and wiper mounting ring 30 are assembled together as shown in FIG. 2 and thereafter mounted as a sub-assembly to the bottle 12. This permits full visual inspection of the wiper and wiper mounting ring, to be certain that the wiper is properly seated and engaged.

With further reference to FIG. 2, the bottle neck 14 has a smooth cylindrical inside surface 60 sized to matingly receive the sidewall 40 of the wiper mounting ring, and the interior surface 60 is further provided with a peripheral groove 62 which receives the bead 48 of the wiper mounting ring in a snap-fit engagement to secure the wiper mounting ring in the bottle neck. (The lower portion of the wiper sidewall is beveled at 64 to ease insertion of the wiper mounting ring and wiper subassembly into the bottle neck.) Upon insertion, the rim 44 of the wiper mounting ring overlays the bottle neck, as best seen in FIG. 1.

Referring again to FIG. 1, with the wiper 24 and wiper mounting ring 30 secured in the neck 14 of bottle 12, the cosmetics container assembly operates in the following manner. Cosmetics, not shown, are placed in the bottle cavity 22. The applicator brush 20 and rod 18 are inserted through the aperture 36 in the wiper diaphragm 34, thereby introducing the applicator brush into the cavity 22 of the bottle 12. For storage purposes, the rod 18 is inserted substantially into the bottle and the cap 16 is screwed onto the bottle neck 14, complementary threads 72 and 74 being provided for this purpose. When the cap is fully screwed onto the bottle neck, the rim 24 of the wiper, which protrudes above the rim 42 of the wiper mounting ring, engages the cap surface 76 to seal the cosmetics within the bottle. Upon unscrewing the cap and withdrawing the rod and applicator brush from the bottle 12, the wiper acts to wipe excess cosmetics from the rod 18 and applicator brush 20 as they are removed from the bottle, thus preparing the cap, rod and applicator for use of the cosmetics.

It will be appreciated that the size and configuration of the wiper mounting ring can be changed according to the diameter or length of bottle neck with which it is desired to use the wiper. Thus, for a larger diameter bottle neck, the sidewall 40 of the wiper mounting ring could be thicker, and in the embodiment described the wiper mounting ring is already shown mounting of the wiper into a bottle neck of longer dimension than the wiper itself. Similarly, the interface between the bottle neck and the exterior of the wiper mounting ring which results in the wiper mounting ring being retained in the bottle neck may be altered from that shown for other applications. It will be appreciated by those skilled in the art that these and other modifications may be made without departing from the spirit and scope of the invention, which is limited only by the following claims.

I claim:

1. A cosmetics container comprising:

a) a bottle for receiving cosmetics, the bottle including a neck, said neck defining a generally cylindrical opening into the cavity of the bottle;

b) a cap having a rod and cosmetics applicator extending therefrom, the rod and applicator extending centrally through the neck opening of the bottle when the cap is secured to the bottle neck;

c) wiper having a tubular sleeve and an apertured wiper diaphragm extending across the opening defined by the tubular sleeve, the wiper being fabricated of a resilient flexible material;

d) a wiper mounting ring including a cylindrical sidewall adapted to mount the wiper on the inside surface thereof, the wiper mounting ring being adapted to be mounted and retained in the neck opening of the bottle, thereby positioning the wiper centrally within the neck opening for receiving the rod and applicator through the apertured wiper diaphragm;

e) the upper end of the wiper mounting ring defining an annular notch adjacent to the inside surface and the wiper including a radially projecting rim matingly received in said notch; and f) the wiper including radially outwardly projecting lugs which engage the lower end of the wiper mounting ring, said rim and lugs together longitudinally positioning the wiper with respect to the wiper mounting ring.

2. A cosmetics container as defined in claim 1 wherein the generally cylindrical entry opening to the bottle defines a peripheral groove, the exterior surface of the tubular wiper mounting ring defines a bead and snap-fit engagement between the bead and groove retain the wiper mounting ring in the bottle neck.

3. A cosmetics container as defined in claim 2 wherein the wiper mounting ring further defines a radially outwardly extending rim which extends over and engages the upper end of the bottle neck.

4. A cosmetics container as defined in claim 3 wherein the lower portion of the cylindrical wall of the wiper mounting ring is beveled for easy insertion into the neck opening of the bottle.

5. A cosmetics container as defined in claim 4 wherein the wiper extends above the upper end of the wiper mounting ring, and provides a resilient seal with the cap.

6. A cosmetics container as defined in claim 5 wherein there are three lugs evenly deployed by the exterior of the wiper sleeve.

7. A cosmetics container as defined in claim 5 wherein the wiper mounting ring defines an inwardly protruding annular flange matingly received in a complementary annular groove defined by the wiper about the exterior of its tubular sleeve, said flange and groove being located near the wiper diaphragm for stabilizing the wiper diaphragm against longitudinal movement within the wiper mounting ring.

8. A cosmetics container as defined in claim 1 wherein there are three lugs evenly deployed by the exterior of the wiper sleeve.

9. A cosmetics container as defined in claim 1 wherein the wiper mounting ring defines an inwardly protruding annular flange matingly received in a complementary annular groove defined by the wiper about the exterior of its tubular sleeve, said flange and groove being located near the wiper diaphragm for stabilizing the wiper diaphragm against longitudinal movement within the wiper mounting ring.

10. A cosmetics container as defined in claim 1 wherein the wiper mounting ring further defines a radially outwardly extending rim which extends over and engages the upper end of the bottle neck.

11. A cosmetics container as defined in claim 1 wherein the lower portion of the cylindrical wall of the wiper mounting ring is beveled for easy insertion into the neck opening of the bottle.

12. A cosmetics container as defined in claim 1 wherein the wiper extends above the upper end of the wiper mounting ring, and provides a resilient seal with the cap.

13. First and second wiper mounting rings for mounting a wiper in the necks of bottles, having different size neck openings, the wiper of the type having a tubular sleeve and an apertured wiper diaphragm extending across the opening defined by the tubular sleeve, and the wiper having a particular size and shape, the wiper mounting rings each comprising:

a generally cylindrical sidewall having an inside surface sized and shaped complementary to the wiper for receiving and holding the wiper therein, the first wiper mounting ring having a sidewall having a thickness and outside surface adapted to be received and retained in a first bottle neck opening, and the second wiper mounting ring having a sidewall having a thickness and outside surface adapted to be received and retained in a second, different size bottle neck opening, whereby the first and second wiper mounting rings permit use of the wiper of particular size and shape in bottle neck openings of various sizes.

14. A wiper mounting ring as defined in claim 13 which is adapted by means of at least one projection thereon for snapfit into the neck opening of a bottle.

15. A wiper mounting ring as defined in claim 13 and further comprising:

a rim radially outwardly projecting from the generally cylindrical sidewall for engaging the upper end of the bottle neck.

* * * * *